US005910808A

United States Patent [19]

Fukasawa et al.

[11] Patent Number: 5,910,808

[45] Date of Patent: Jun. 8, 1999

[54] PUMP UNIT INCLUDING PUMP FRAME, PUMP WHEEL AND PULLEY AND METHOD FOR USING THE PUMP UNIT TO SQUEEZE A TUBE FOR SUCKING INK FROM A NOZZLE OPENING IN A RECORDING HEAD

[75] Inventors: Shigenori Fukasawa; Masahiro Isono; Kazuhisa Kawakami; Seiji Mochizuki; Nobuhito Takahashi; Atsushi Kobayashi, all of Nagano, Japan

[73] Assignee: Seiko Epson Corporation, Tokyo, Japan

[21] Appl. No.: 08/651,256

[22] Filed: May 23, 1996

[30] Foreign Application Priority Data

May 25, 1995 [JP] Japan ..... 7-151010

[51] Int. Cl.[6] ..... B41J 2/165

[52] U.S. Cl. ..... 347/30; 347/33

[58] Field of Search ..... 347/30, 31, 33; 417/477.5, 477.6, 477.9, 477.1, 223; 400/701

[56] References Cited

U.S. PATENT DOCUMENTS 5,309,180 5/1994 Uchida ..... 347/30
5,382,969 1/1995 Mochizuki et al. ..... 347/30

FOREIGN PATENT DOCUMENTS 0532300 3/1993 European Pat. Off. ..... B41J 1/175
0575153 12/1993 European Pat. Off. ..... H04N 1/12
3148683 6/1983 Germany ..... F04C 5/00
407017061 1/1995 Japan ..... 347/30

*Primary Examiner*—Benjamin R. Fuller
*Assistant Examiner*—Thien Tran
*Attorney, Agent, or Firm*—Sughrue, Mion, Zinn, Macpeak & Seas, PLLC

[57] ABSTRACT

A pump unit and corresponding method for applying negative pressure to a capping device to prevent clogging of a nozzle opening in an ink jet printer includes a frame having a supporting surface on which a pump tube is disposed. A plurality of gears which are driven by a motor of the ink jet printer are disposed in the frame. A plurality of pulleys are rotatably mounted to one of the gears for applying a pressure to the pump tube to thereby generate a negative pressure in the pump tube. The maximum contact region between the pulleys and the tube in the pump frame is selected to be smaller than 180° to allow for the load applied to the tube by the pulleys to be essentially constant. Damper sheets are economically disposed in the frame to position the pulleys to contact the tube when the gear on which the pulleys is driven in a certain direction. The tube is lead out of the frame in a manner so that at least one half of the tube is bent at right angles at a position where the tube separates from the tube supporting surface and is fixed in a slot formed in the pump frame. Accordingly, the frame space facing the tube supporting surface is used effectively, and the tube can be freely lead to a connection point external of the pump frame.

15 Claims, 11 Drawing Sheets

PUMP UNIT INCLUDING PUMP FRAME, PUMP WHEEL AND PULLEY AND METHOD FOR USING THE PUMP UNIT TO SQUEEZE A TUBE FOR SUCKING INK FROM A NOZZLE OPENING IN A RECORDING HEAD

BACKGROUND OF THE INVENTION

1. Field of the Invention

The present invention relates to a pump unit for use with an ink jet printer having an ink jet recording head which moves in the direction of the width of recording paper and jets ink drops onto the recording paper so as to form dots in accordance with printing data and, more particularly, to the structure of the pump unit and corresponding method for applying negative pressure to a capping device to prevent clogging of a nozzle opening in such an ink jet printer.

2. Description of the Related Art

In a conventional on-demand ink jet recording apparatus, ink that is pressurized in a pressure generation chamber is jetted in the forms of ink drops onto recording paper through a nozzle so as to perform data recording/printing. In such a conventional printer, defective printing often occurs due to an increase in the viscosity of the ink caused by evaporation of an ink solvent from a nozzle opening, drying of the ink, adhesion of dust to the nozzle opening, a mixture of bubbles in the ink being jetted, or the like.

In an attempt to eliminate these problems, the conventional ink jet recording apparatus includes a capping device for sealing the nozzle opening during the time when the printer is inactive. The capping device acts as sealing device which applies negative pressure from a suction pump to the nozzle opening when the recording head is filled with new ink or when the nozzle opening is clogged. The capping device, however, acts only as a cap which seals the nozzle opening during the time when the printer is inactive.

Typically, a tube pump is used as the suction pump because such a tube pump is simple in structure and small. The tube is squeezed by two pulleys which are symmetrically positioned with respect to a center of rotation. If the tube pump is reduced in size too much, however, the region where the two pulleys abut on the tube at the same time relatively increases, so that a large load is instantaneously applied to the pulleys, as represented by the graph shown in FIG. 13(*b*). Such a phenomenon makes it difficult to perform a smooth sucking operation.

In an attempt to solve this problem, the diameter of the pulleys has been reduced. However, when this is done, the friction generated between the pulleys and the tube increases so that smooth driving cannot be performed. Further, although the tube can be made thin, by doing this, its suction ability is reduced, thus warranting high-speed driving of the pump in order to obtain the same amount of suction as in the larger tube pumps.

In another attempt to solve the above problems in the conventional apparatus, a paper feed mechanism driving motor, which is stopped during execution of the sucking operation, is also used as the tube pump driving device for the purpose of simplifying the overall structure of the printer. To use the paper feed driving motor in this manner, it is necessary to provide a change-over device which includes axially moving toothed gears. However, if the size of the toothed gears are reduced in order to miniaturize the overall size of the apparatus, it becomes difficult for the gears to perform a smooth change-over.

SUMMARY OF THE INVENTION

An object of the present invention is, therefore, to provide a tube pump suitable for an ink jet printer which can be reduced in size while having a reduced fluctuation in the amount of load torque applied to the tube. Another object of the present invention is to provide a tube pump for an ink jet printer in which change-over of power transmission can be smoothly performed even if power provided by only one motor is used for several purposes other than driving the tube pump.

In order to achieve the above objects, the present invention provides a pump unit for use with an ink jet recording apparatus having a carriage on which an ink jet recording head is mounted, a capping device for sealing a nozzle opening of the recording head, and a cleaning unit adapted to abut on the recording head so as to clean the recording head. The pump unit is driven to apply negative pressure to the capping device. The pump unit includes a pump frame having a tube supporting surface for directing a portion of the tube in a curved manner to form a substantially semicircular portion of the tube, and a pump wheel rotated by a driving force provided from a driving device. Two pulleys are rotatably mounted on the pump wheel in a manner so as to be positioned symmetrically with respect to a center of rotation of the pump wheel, to thus squeeze the tube in the frame during a sucking operation.

The maximum contact region between the tube and the pulleys in the pump frame is selected to be smaller than 180°, and preferably, is 173° or approximately 173°. Damper sheets, made of an elastic member or the like, are fixed to the pump frame in opposition to the tube supporting surface so as to abut against the pulleys when the pump wheel is rotated. Also, at least one half of the tube is bent at right angles at a position where the tube separates from the tube supporting surface and is fixed in a slot formed in the pump frame.

Because the maximum contact angle between the pump tube and the pulleys is selected to be smaller than 180°, the size of the load at the switching time when the pulleys abut against the tube is substantially the same as the size of the load when the tube is squeezed. Further, the damper sheets can be accommodated by effectively using the region which faces the tube supporting surface and which does not contribute to the pumping operation. Moreover, one half of the tube is bent by the frame in a specific direction so that the part of the tube beyond the bend can be freely lead.

BRIEF DESCRIPTION OF THE DRAWINGS

These and other objects and advantages of the invention will become more apparent and more readily appreciated from the following detailed description of the presently preferred exemplary embodiments of the invention taken in conjunction with the accompanying drawings, of which:

FIG. 13(*b*) illustrates the relationship between the rotary angle and the load torque in the tube pump in a conventional tube pump.

DETAILED DESCRIPTION OF THE PREFERRED EMBODIMENTS

Figure 1:
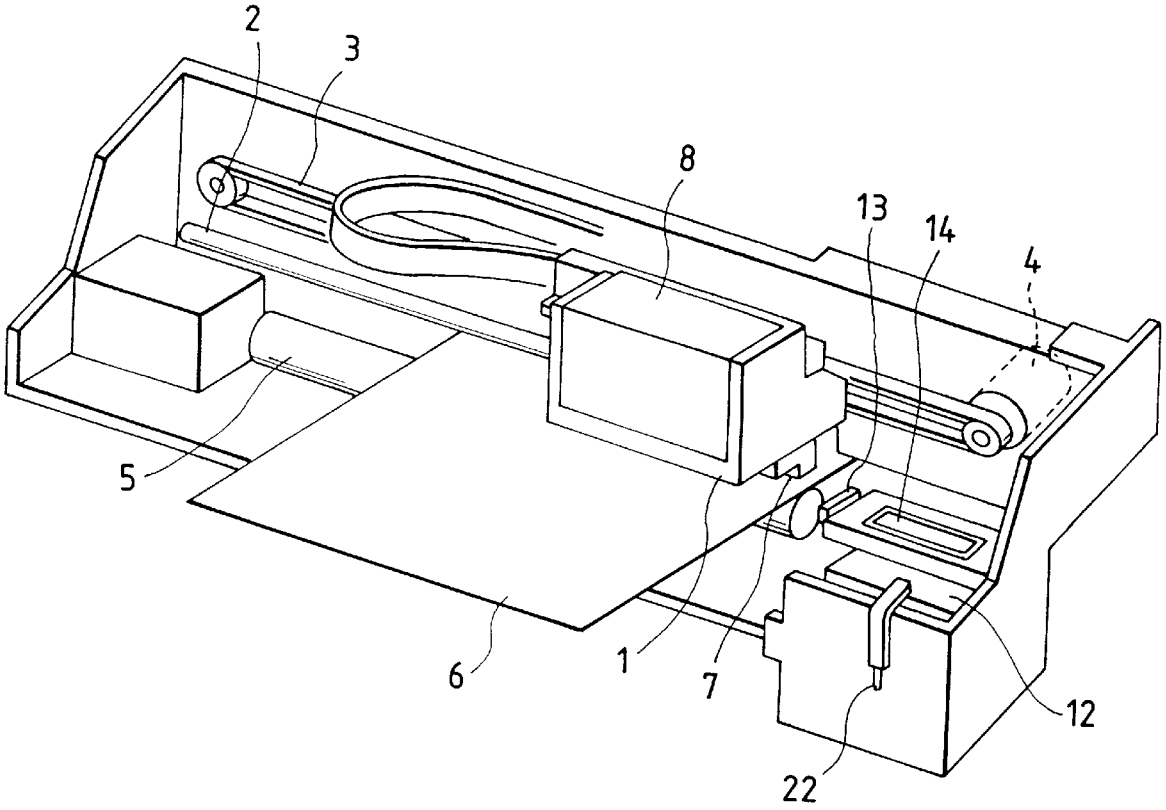
FIG. 1 is a perspective view showing an example of the structure of the printing mechanism of an ink jet recording apparatus in which an embodiment of the pump unit according to the present invention is employed.

FIG. 1 is a schematic diagram illustrating the periphery of the printing mechanism of an ink jet recording apparatus in which an embodiment of the pump unit and capping device according to the present invention are employed. The recording apparatus includes a carriage 1 which is supported on a guide member 2, and which is connected to a pulse motor 4 through a timing belt 3, so as to travel in parallel to a platen 5. A recording head 7 is mounted on the carriage 1 so that its nozzle opening face recording paper 6, and an ink cartridge 8 is removably mounted on an upper portion of the recording head 7.

The apparatus further includes a paper feed motor 10 (see, e.g., FIG. 2) for driving selected one of a paper feed roller (not shown), a pump unit 12 (to be described later), and a cleaning unit 13. The paper feed motor 10 is selectively connected to the paper feed roller and the pump unit 12 through a change-over lever operated by the movement of the carriage 1.

A capping device 14 is provided in the vicinity of a non-printing region so as to seal a nozzle opening surface of the recording head 7 in accordance with the movement of the carriage 1. The capping device 14 is connected to a tube 22 which is connected to the foregoing pump unit 12 so as to receive negative pressure from the pump unit 12 to make the recording head 7 forcibly jet ink at the time when ink fills into the recording head 7, for example, during the exchange of an ink cartridge 8 or to unclog the nozzle opening.

FIGS. 2–12 show an embodiment of the pump unit according to the present invention, along with various mechanisms located in the periphery of the pump unit. The pump unit includes a base 20 for accommodating the paper feed motor 10 and a train of wheels. The pump is unit 12 and cleaning unit 13 are fixed on the base 20.

The pump unit further comprises a pump frame 21 which includes a tube supporting surface 23, a lower lead-out opening 25, an upper lead-out opening 26 (shown in FIG. 5), a slot 27, and a pawl 30. The tube supporting surface 23 supports a tube 22 so that the central portion of the tube 22 is shaped to be semicircular or substantially semicircular. The lower lead-out opening 25 is formed in an end portion of the supporting surface 23 so as to horizontally or substantially horizontally lead out one end of the tube 22 to make the tube 22 coincide with the tangent of the supporting surface 23. The upper lead-out opening 26 leads out the other end of the tube 22 so as to make the tube 22 coincide with the tangent of the supporting surface 23.

The slot 27 bends the tube 22, which is projected from the lead-out opening 26, horizontally at a right angle in the vicinity of the outlet, and further bends the forward end of the bent tube 22 downward substantially at a right angles so as to lead out the forward end backward around the outside. The pawl 30 fixes the tube 22 in a recess portion 29 of the base 20. The tube 22 is further fixed by the lead-out openings 25 and 26 so as to form a space 34 (shown in FIG. 5) between the tube 22 and the tube supporting surface 23 in a squeezing region which will be described later.

Figure 7:
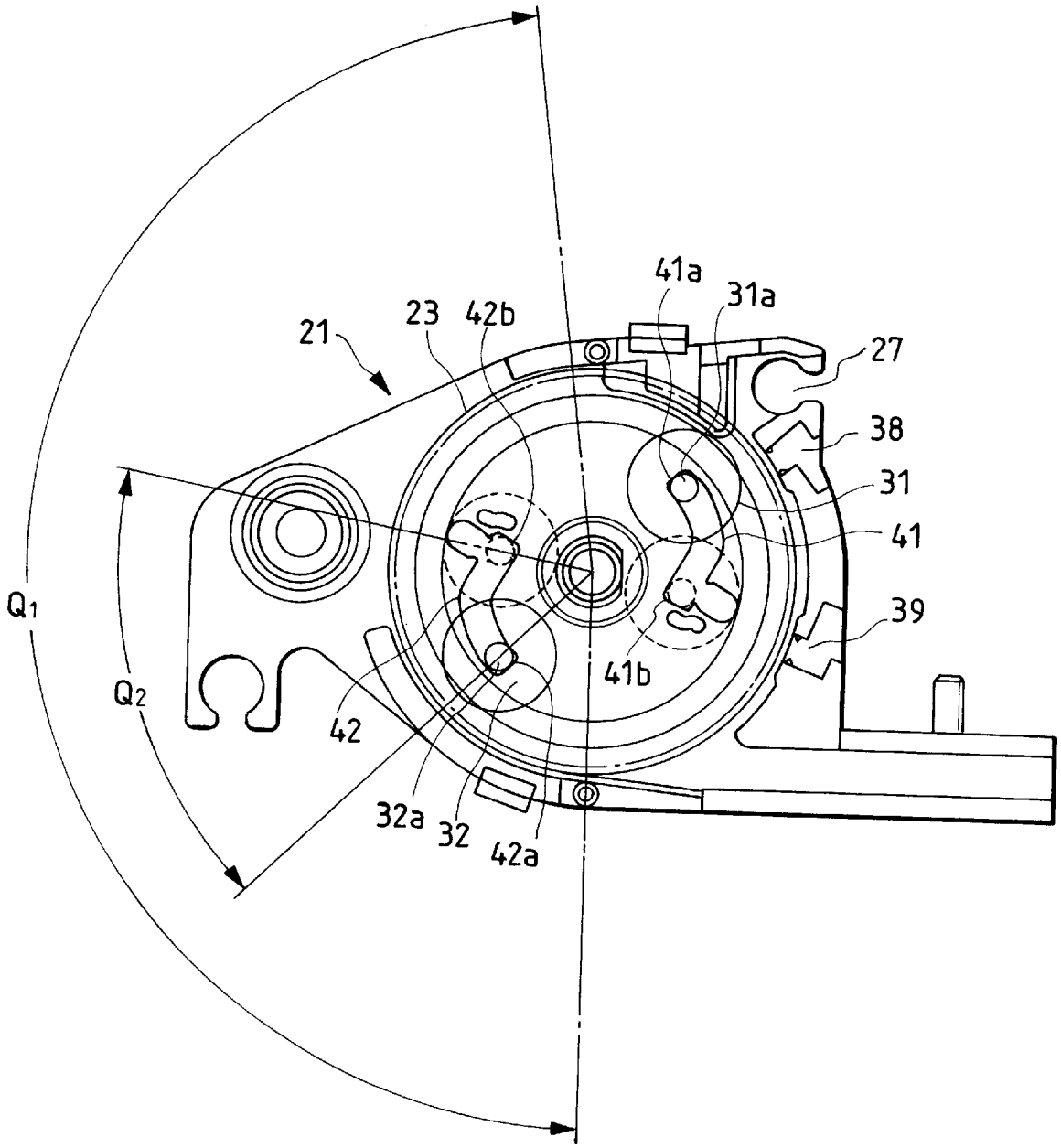
FIG. 7 is a view showing an example of the elongated slots for driving pulleys of the embodiment of the pump unit shown in FIG. 2.
Figure 8A:
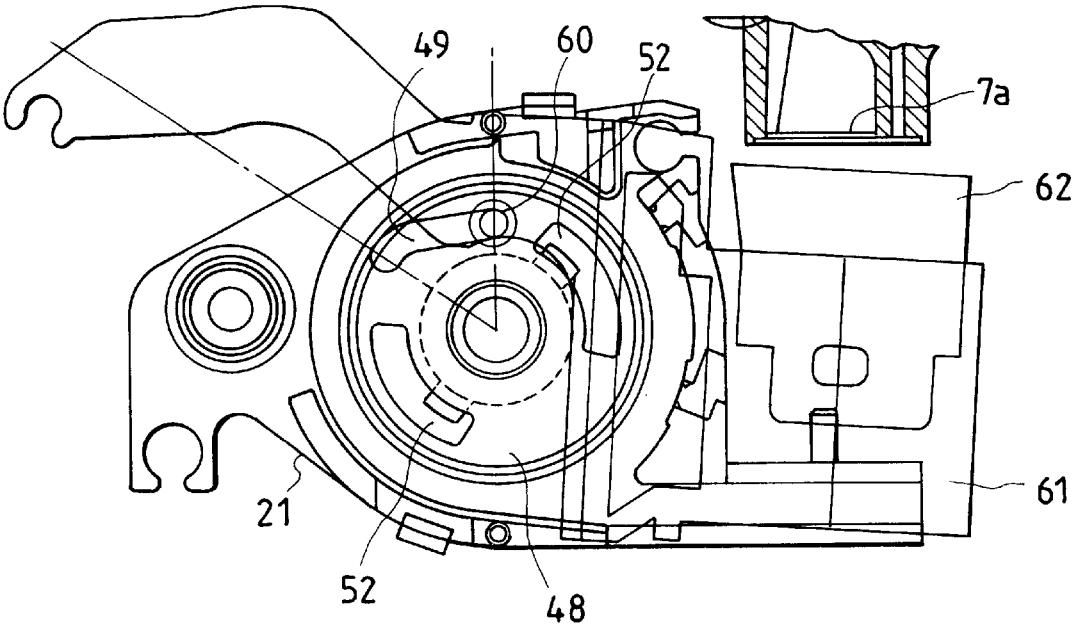
FIGS. 8(*a*) and 8(*b*) illustrate the operation of a cam plate for driving a cleaning blade in accordance with the embodiment of the pump unit shown in FIG. 2.
Figure 8B:
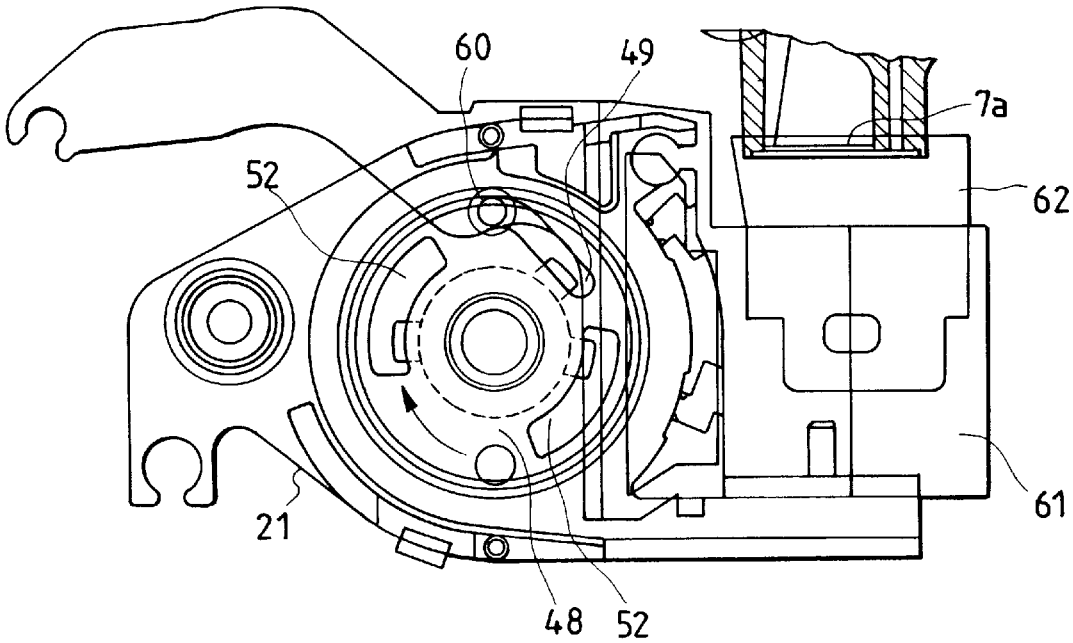

In order to make the load torque to be applied to the motor 10 constant during operation of the pump, the shape of the tube supporting surface 23 and the positions of the lead-out openings 25 and 26 are selected so that, as shown in FIG. 7, the central angle θ1 of the squeezing region by the pulleys 31 and 32 is a maximum of 180°, and, in this embodiment, 173°. Further, in a region 33, which faces the supporting surface 23 and acts as a dead space, two damper sheets 35 and 36 made of an elastic plate material such as rubber or the like are provided radially in a manner so that ends of the damper sheets 35 and 36 are located so as to contact the pulleys 31 and 32, respectively, while the other ends of the damper sheets 35 and 36 are fitted in slots 38 and 39 of the pump frame 21. By providing the damper sheets 35 and 36 in the region 33, which is a dead space as described above, instead of in another location, the size of the pump can be reduced.

As further illustrated in FIG. 7, the apparatus includes a pump wheel 28 having a cylindrical outer-toothed gear which engages with one of the change-over toothed gears, which are described later. Respective pulley supporting slots 41 and 42 are formed in a surface 40 facing the pump frame 21 so as to support rotary shafts 31*a* and 32*a* of the two pulleys 31 and 32 which compress the tube 22. The pulleys 31 and 32 also have rotary shafts 31*b* and 32*b*, respectively, on their outer circumferences.

Figure 4:
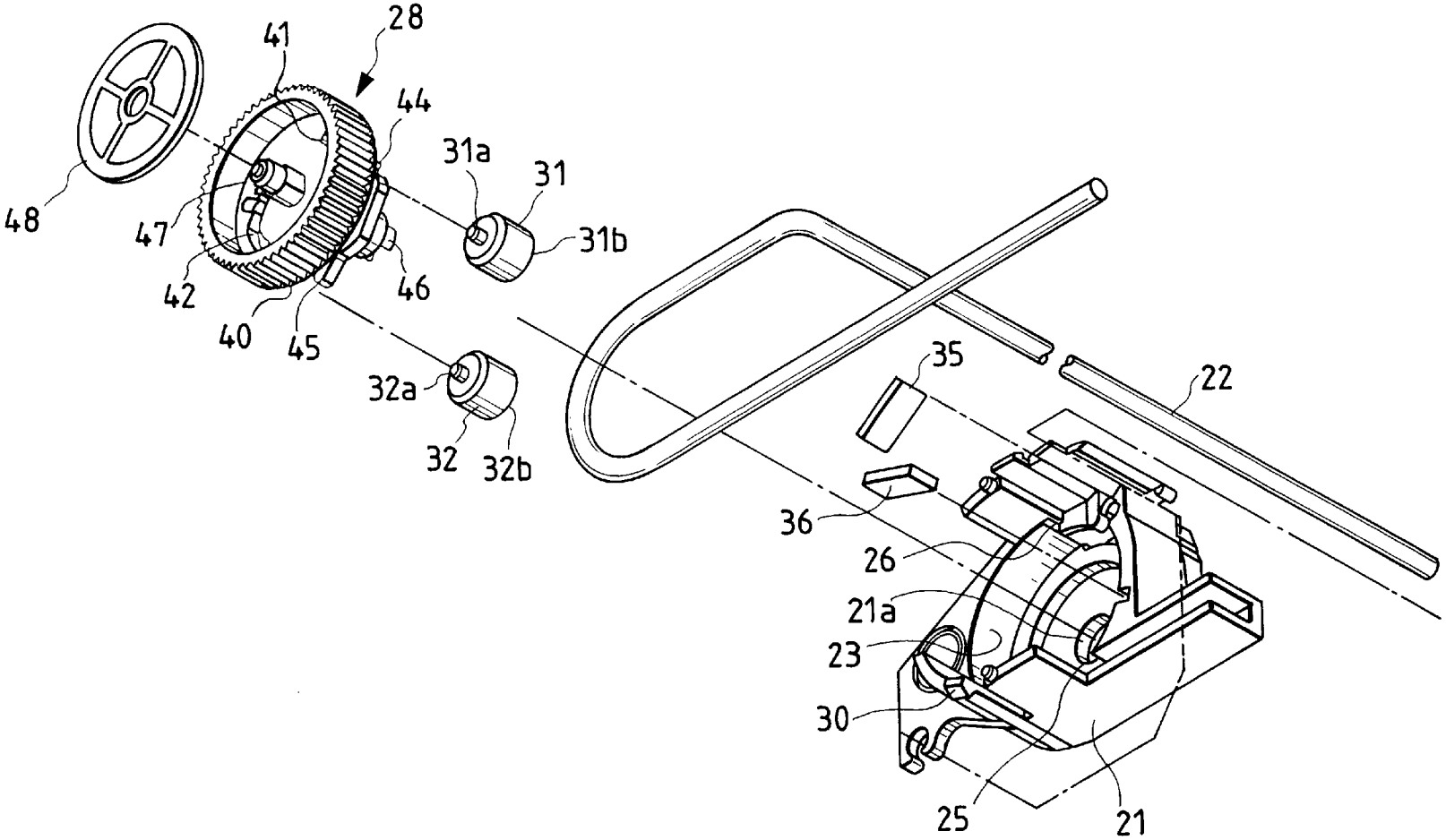
FIG. 4 is an exploded perspective view showing the details of a pump wheel and a pump frame of the pump unit shown in FIG. 2.
Figure 5:
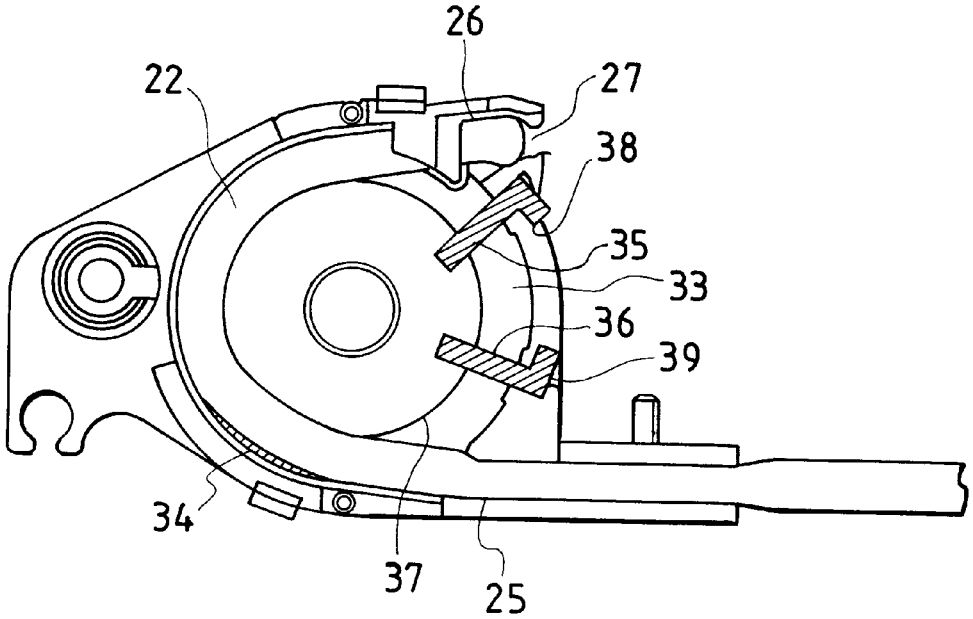
FIG. 5 is a cross sectional view of the pump unit shown in FIG. 2, as taken along lines 5—5, which illustrates an embodiment of the damper sheets provided in the pump unit.

As shown in FIG. 4 specifically, the pump wheel 28 includes a shaft 46 which has projections 44 and 45 that respectively abut against the ends of the rotary shafts 31*b* and 32*b* so as to prevent the pulleys 31 and 32 from dropping out of the slots 41 and 42. The projections 44 and 45 also restrict the positions of pulleys 31 and 32 during the time when the pump is being driven, so that the pulleys 31 and 32 remain located symmetrically with respect to the center of rotation of the pump wheel 28.

That is, the pulleys 31 and 32 are positioned at a circumferential interval of 180°. The shaft 46 is rotatably inserted into a through hole 21*a* formed in the side surface of the pump frame 21 so that the pump wheel 28 is supported by the pump frame 21.

The pulley supporting slots 41 and 42, on the other hand, are formed as paths connecting the outermost ends 41*a* and 42*a* to the innermost ends 41*b* and 42*b*, respectively, as shown in FIG. 7. The outermost ends 41*a* and 42*a* are the positions where the pulleys 31 and 32 are displaced by a predetermined distance from the center of rotation toward the outer circumference when the pump wheel 28 is rotated in the direction to drive the pump, that is, where the pulleys 31 and 32 squeeze the tube 22 to thereby make the tube 22 act as a pump. On the other hand, the innermost ends 41*b* and 42*b* are the positions where the pulleys 31 and 32 are displaced toward the central axis so as not to contact the tube 22 when the pump wheel 28 is rotated in a reverse manner.

In the pulley supporting slots 41 and 42, the angle θ2 between the lines connecting the center of rotation to the outermost end 41*a* (or 42*a*) and to the innermost end 41*b* (or 42*b*) is selected to be a certain value, for example, 56° in this embodiment. However, any suitable spacing can be used. This 56° spacing enables pump wheel 28 to move that angular distance without inducing a pumping operation when the front end of a cleaning blade 62 (see FIGS. 8(*a*) and 8(*b*)) is moved between a position where the front end is separated from a nozzle plate 7*a* of the recording head 7 (FIG. 8(*a*)) and a position where the front end abuts against the nozzle plate 7*a* (FIG. 8(*b*)).

The pump wheel 28 further includes a shaft 47 that is provided in an inside space of the pump wheel 28, and a clutch plate 48 which is inserted on the shaft 47 so as not to rotate relative to the shaft 47. As shown specifically in FIG. 2, the cleaner cam plate 54 has a through hole 54*a* through which the shaft 47 is inserted to mount the cleaner cam plate 54 on the shaft 47. The shaft 47 rotates the cleaner cam plate 54 at the shaft, so that the cleaner cam plate 54 contacts the clutch plate 48. The cleaner cam plate 54 has a cam slot 49 which engages with a projection 51 of a blade operation rod 50, and has pawls 52 which engage slots in the base 20 so as to restrict the rotary angle of the plate 54.

Figure 2:
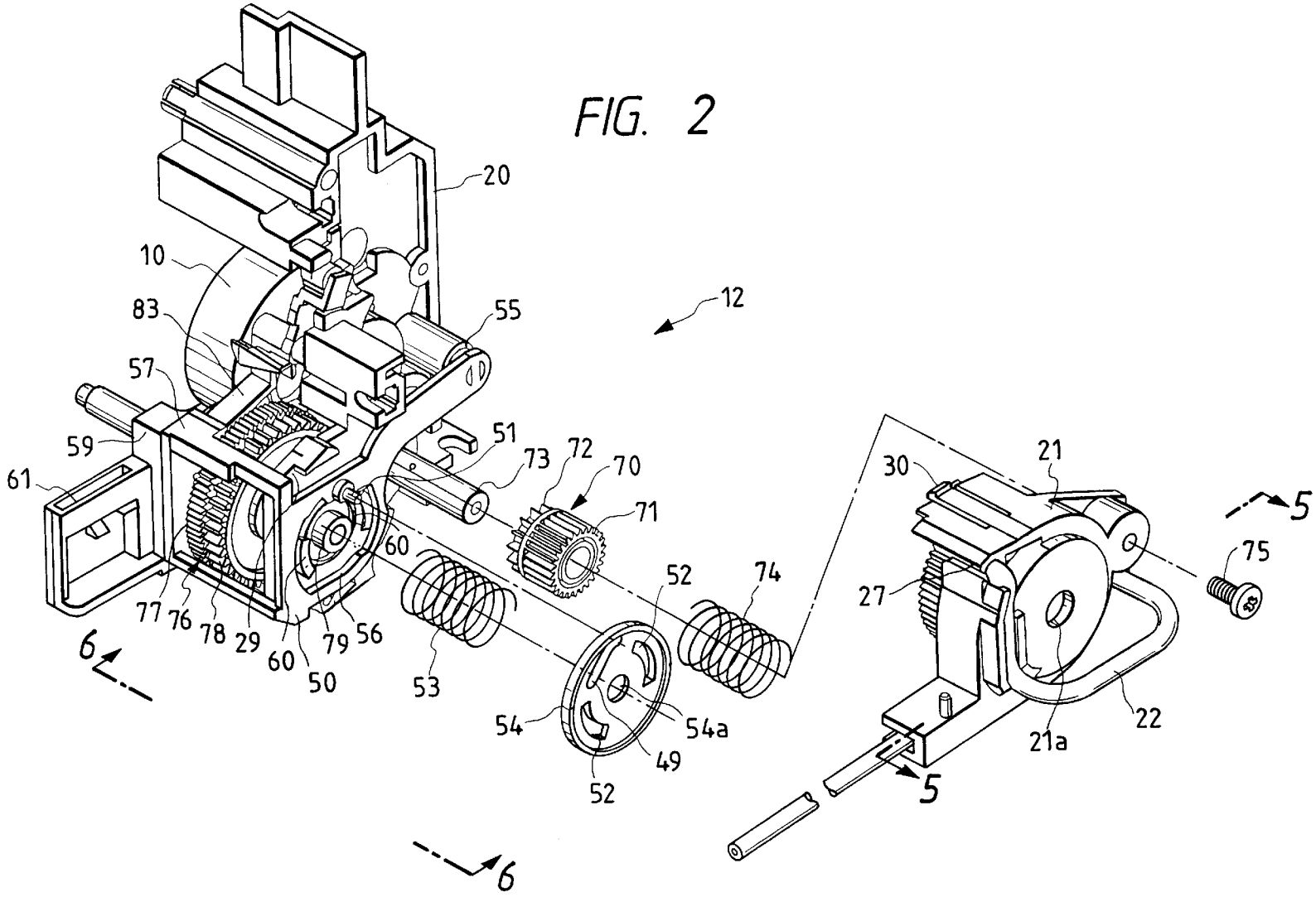
FIG. 2 is an exploded perspective view of an embodiment of the pump unit according to the present invention as viewed from a side surface of the base of the ink jet recording apparatus.
Figure 6:
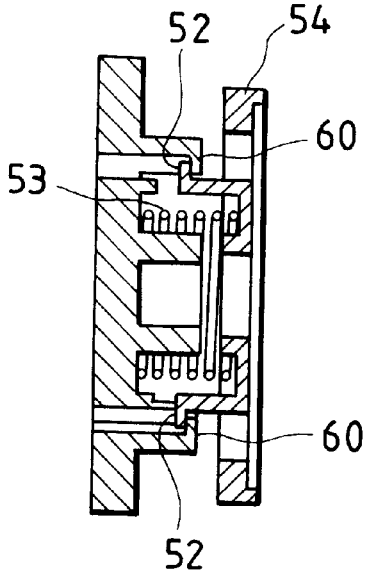
FIG. 6 is a cross sectional view of the pump unit shown in FIG. 2, as taken along lines 6—6, which illustrates the relationship between a cleaner cam plate and pawls of the base.

In particular, as shown in FIG. 6, the pawls 52 of the cleaner cam plate 54 engage with arched projections 60 of the base 20 so that a spring 53, which is interposed between the base 20 and the pawls, is compressed when the pump frame 21 is fixed to the base 20 by the pawl 30. As shown in FIG. 2, the blade operation rod 50 has one end which is rotatably supported in a through hole 55 formed in a surface of the base 20 at its one side on which the pump frame 21 is fixed. The other end of the rod 50 further extends in a direction toward the carriage 1 (see FIG. 1). A window 56 is formed in the blade operation rod 50 at the region covered with the pump frame 21, so that the cleaner cam plate 54 is accommodated in the window 56.

Figure 3:
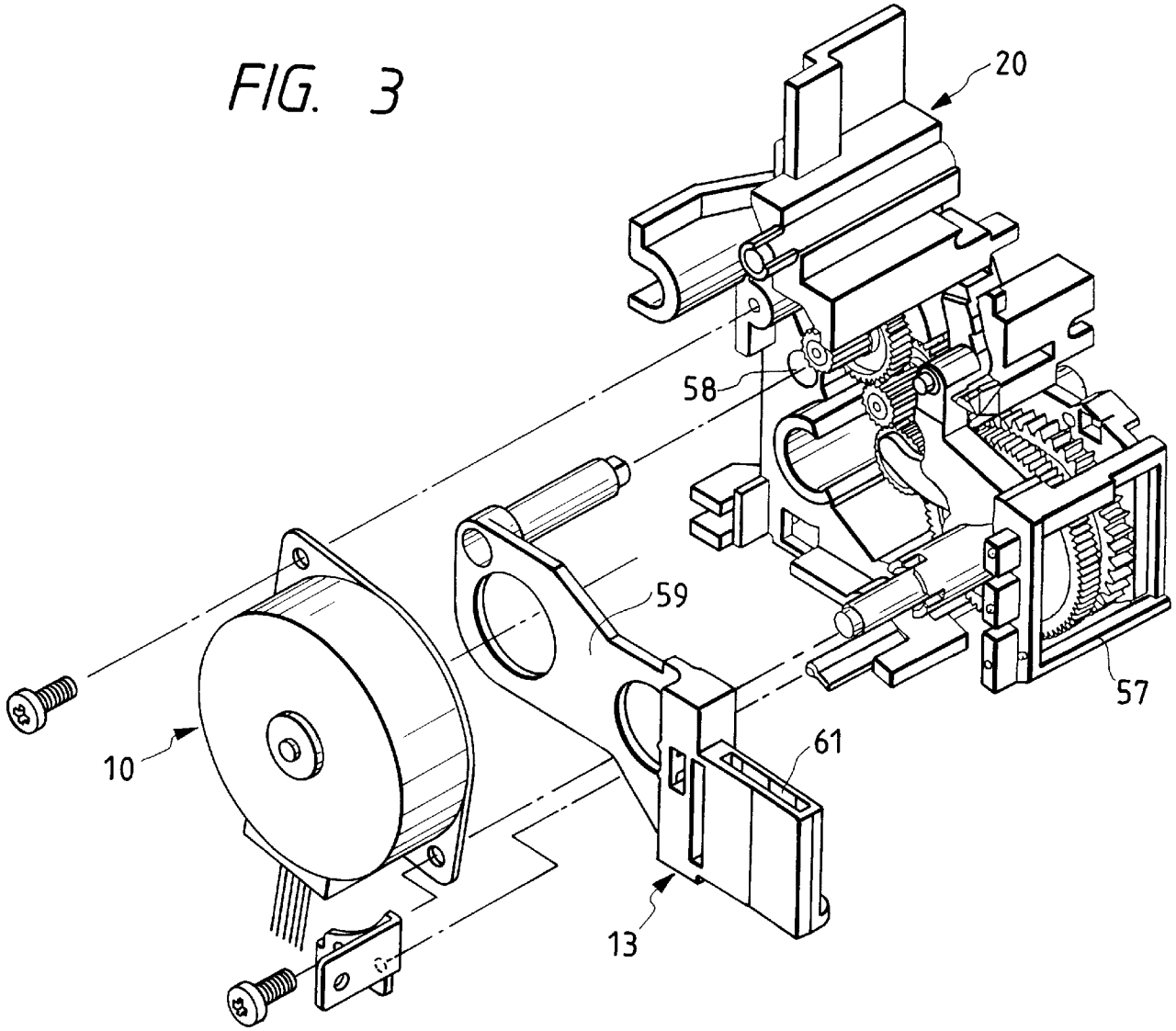
FIG. 3 is an exploded perspective view of the embodiment of the pump unit shown in FIG. 2 as viewed from the other side surface of the base of the ink jet recording apparatus.

As shown in FIG. 3 specifically, a blade supporting body 59, integrally provided with the cleaning unit 13, is rotatably supported at a through hole 58 which is formed in the other side surface of the base 20 at a portion symmetrical with the through hole 55. The cleaning unit 13, which is configured as a frame structure which generally covers the base 20, is attached to the blade operation rod 50 by a connection member 57. Since the projection 51 of the blade operation rod 50 in the region facing the pump frame 21 engages with the cam slot 49 of the cleaner cam plate 54, the blade operation rod 50 is swung with the rotation of the cleaner cam plate 54 so that a blade 62 fixed on a blade supporting portion 61 moves up and down between two positions shown in FIGS. 8(*a*) and 8(*b*).

Figure 10:
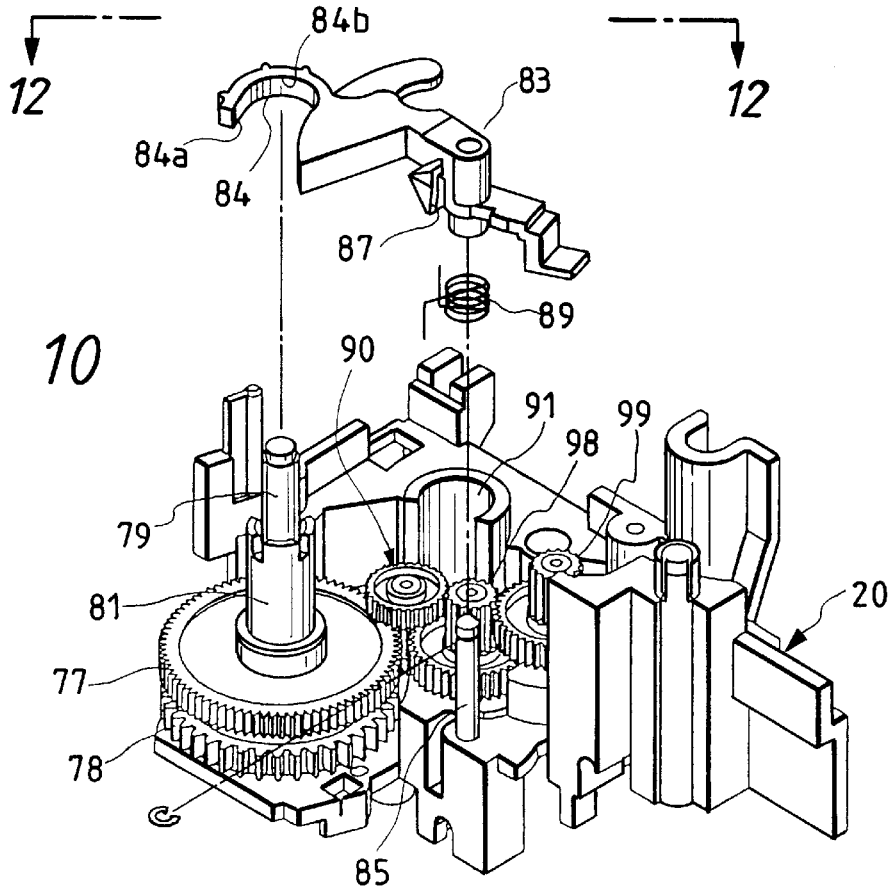
FIG. 10 is an exploded view illustrating the structure of a change-over toothed gear attached on the base, and wheel rows which mesh with the change-over toothed gear, in accordance with the embodiment of the pump unit shown in FIG. 2.
Figure 11:
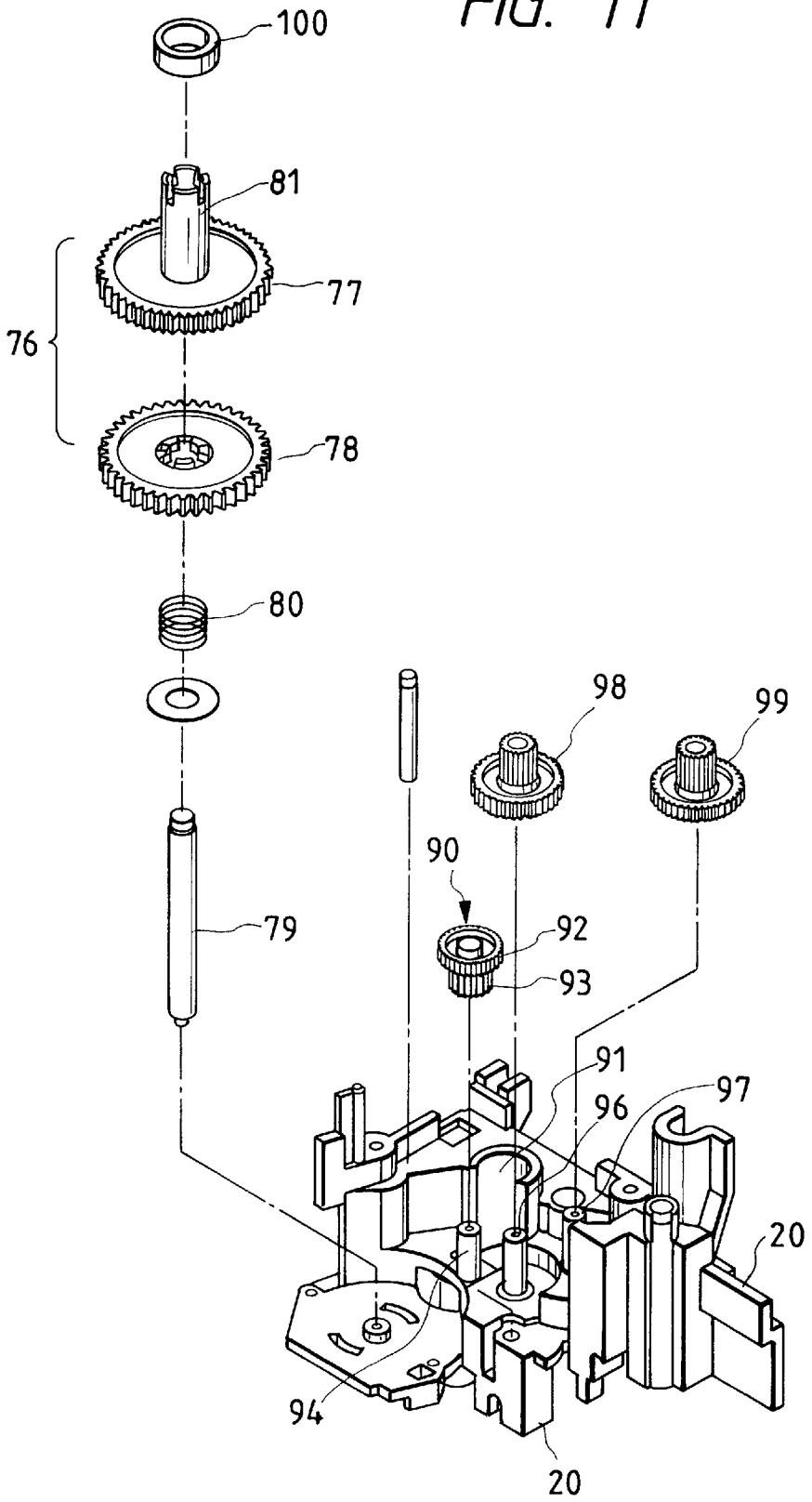
FIG. 11 is an exploded perspective view illustrating an embodiment of the change-over toothed gear shown in FIG. 10.

As shown in FIG. 2, a compound toothed gear 70 is selectively meshed with a change-over toothed gear 76 to drive the pump wheel 28. The change-over toothed gear 76 includes a first toothed gear 77, adapted to drive the paper feed roller, and a second toothed gear 78, adapted to mesh with the change-over toothed gear 72 of the compound toothed gear 70 which engages with the pump wheel 28, as shown in FIGS. 10 and 11. The compound toothed gear 70 includes a transfer toothed gear 71, which normally engages with the pump wheel 28, and a change-over toothed gear 72, which is adapted to mesh with a second toothed gear 78 of a change-over toothed gear 77. The transfer and change-over toothed gears 71 and 72 are formed integrally with each other. The compound toothed gear 70 is inserted on a shaft 73 extending from the base 20 so as to be ratable and movable in the axial direction. The compound toothed gear 70 is normally urged toward the base 20 by a spring 74, and is fixed by a screw 75 inserted through the pump frame 21.

The first and second toothed gears 77 and 78 are attached so as not to be rotatable relative to each other and so as to be movable along the shaft 79 by a change-over lever 83. The first and second toothed gears 77 and 78 are further normally urged by a spring 80 toward a position where they are disengaged from the pump wheel 28.

In addition, the change-over toothed gear 76 is configured so that a tapered cylinder 81 having a tapered front end is fixed on the outside surface of the first toothed gear 77, so as to be moved by the rotation of the change-over lever 83 against the spring 80 to a position where the change-over toothed gear 76 meshes with the gear 70 which further meshes with the pump wheel 28. The change-over lever 83 has, at its front end, a cam surface 84 which includes small and large diameter portions 84*a* and 84*b*, respectively, and which is rotatably mounted on a shaft 85 of the base 20. The change-over lever 83 is urged by a torsion spring 86, attached to the base 20, in a direction so that the large diameter portion 84*b* normally abuts on the tapered cylinder 81, as shown in FIG. 12.

Figure 12:
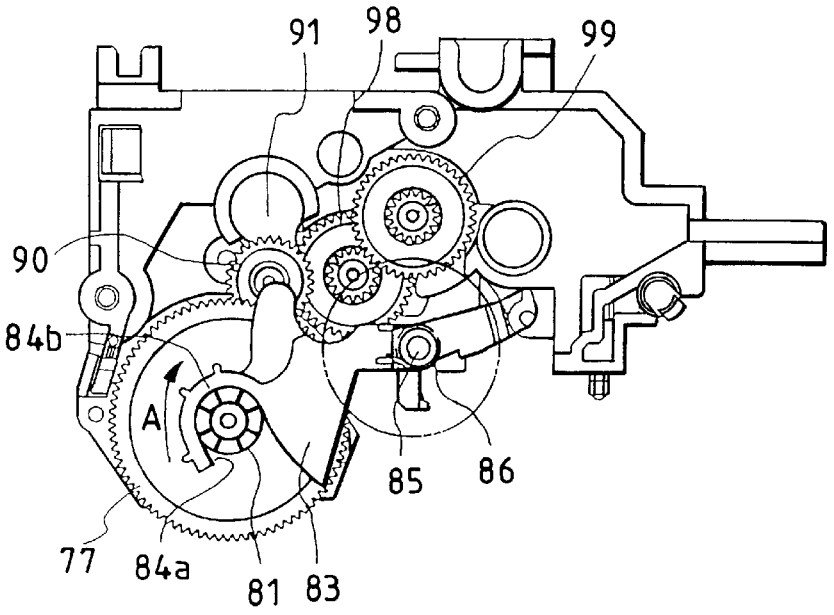
FIG. 12 is a side view taken along lines 12—12 in FIG. 10 illustrating the relationship between the change-over lever and the change-over toothed gear, and between the change-over lever and each of the wheel rows.

The lever 83 further has a change-over path 87 at its surface facing the carriage 1, and rotates in the direction of an arrow A shown in FIG. 12 in accordance with the specific type of movement of the carriage 1. This rotation urges the front end small diameter portion 84*a* toward the tapered cylinder 81 against the force of the springs 80 and 86, to thus cause the second toothed gear 78 of the change-over toothed gear 76 to engage with the toothed gear 72 of the compound toothed gear 70. The change-over path 87 is configured as a cam surface which engages with a projection (not shown) formed on the carriage 1 so that the path 87 is urged or not urged to maintain its original position in accordance with reciprocation of the carriage 1 over a short distance through a specific path of travel.

Additionally, a toothed gear 90 meshes with a gear (not shown) that is fixed on the rotary shaft of the paper feed motor 10 which extends in a direction toward the pump through a through hole 91 of the base 20. The toothed gear 90 includes a large toothed gear 92, which normally meshes with the motor 10, and a small toothed gear 93, which is formed integrally with the large toothed gear 92 and has gear width substantially equal to the stroke length of the change-over toothed gear 76 so as to normally mesh with the first toothed gear 77 of the change-over toothed gear 76. The toothed gear 90 is rotatably attached on a shaft 94. The small toothed gear 93 is connected to the paper feed roller through toothed gears 98 and 99 attached on shafts 96 and 97, respectively, and a one-way clutch (not shown). Further, a spacer 100 is provided, whose size is as needed.

In this embodiment, the change-over toothed gear 76 is urged by the spring 80 so as to be separated from the compound toothed gear 70 in the state where the carriage 1 moves in the printing region. Therefore, when the motor 10 rotates in the forward direction, the paper feed roller is driven so as to carry recording paper to the printing position so that printing can be performed. The motor 10 is driven by a predetermined number of revolutions to execute paper feeding every time one-line printing is completed.

When the cleaning and pump units 13 and 14 are driven after completion of the printing, the carriage 1 is made to perform a specific reciprocation so that the change-over lever 83 is rotated by the carriage 1 in the direction of the arrow A, as shown in FIG. 12. As a result, the tapered cylinder 81 is pushed by the tapered surface 84 so that the second toothed gear 78 of the change-over toothed gear 76 meshes with the toothed gear 72.

Additionally, in this embodiment, the change-over toothed gear 76 is configured such that the first and second toothed gears 77 and 78 are made identical or substantially identical in pitch circle. The number of teeth of the first toothed gear 77 is selected to be one over an integral number, i.e., 1/2 in this embodiment, of that of the second toothed gear 78, and the toothed gears 77 and 78 are designed so that their teeth face each other in the axial direction. Therefore, a large amount of play exists between the respective teeth of the toothed gears 78 and 72, so that the second toothed gear 78 and the toothed gear 72 smoothly mesh with each other with the movement of the change-over toothed gear 76.

When the motor 10 is rotated reversely to the direction at the time of printing in the foregoing state, the driving force to the paper feed roller is stopped by the one-way clutch provided between the paper feed roller and a wheel row 99. On the other hand, the pump wheel 28 is rotated by the driving force received from the motor 10 through the change-over toothed gear 76 so that the pulleys 31 and 32 attached on the pump wheel 28 revolve. The pulleys 31 and 32 contact the damper sheets 35 and 36, respectively, during the revolution so that the rotary shafts 31*a*, 31*b*, 32*a*, and 32*b* are compulsorily moved to the outermost ends 41*a* and 42*a* along the slots 41 and 42. As a result, the pulleys 31 and 32 are positioned, by engagement pieces 44 and 45 of the wheel 46, in the symmetrical positions of 180° with respect to the center of rotation so as to elastically contact to the tube 22.

The rotation is continued in this state so that the tube 22 is squeezed alternately by the pulleys 31 and 32 between the pulley 31 and the tube supporting surface 23 of the frame 21, and between the pulley 32 and the same tube supporting surface 23, to thereby generate a sucking force. As a result, negative pressure acts on the nozzle plate 7*a* through the capping device 14 (which has been applied over the nozzle plate 7*a*) to make the nozzle plate 7*a* jet ink.

The tube 22 is supported on the tube supporting surface 23 of the frame 21 so that the central angle in contact with the pulleys 31 and 32 is set to a value smaller than 180°, as described above (e.g., 173° in this embodiment). Consequently, when one pulley 31 is gradually separated from the tube 22 to thereby gradually reduce the load torque generated by the contact of the pulley 31 with the tube 22, the other pulley 32 abuts on the tube 22 to begin squeezing of the tube 22 so that the load torque of the pulley 32 increases to a stationary value.

Figure 13A:
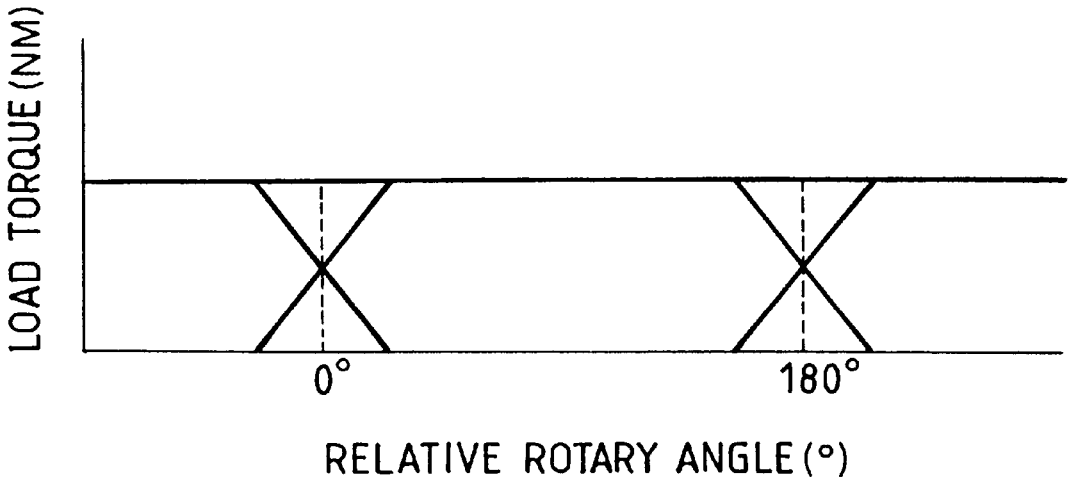
FIG. 13(*a*) illustrates the relationship between the rotary angle and the load torque in the tube pump used in the embodiment of the pump unit shown in FIG. 2.
Figure 13B:
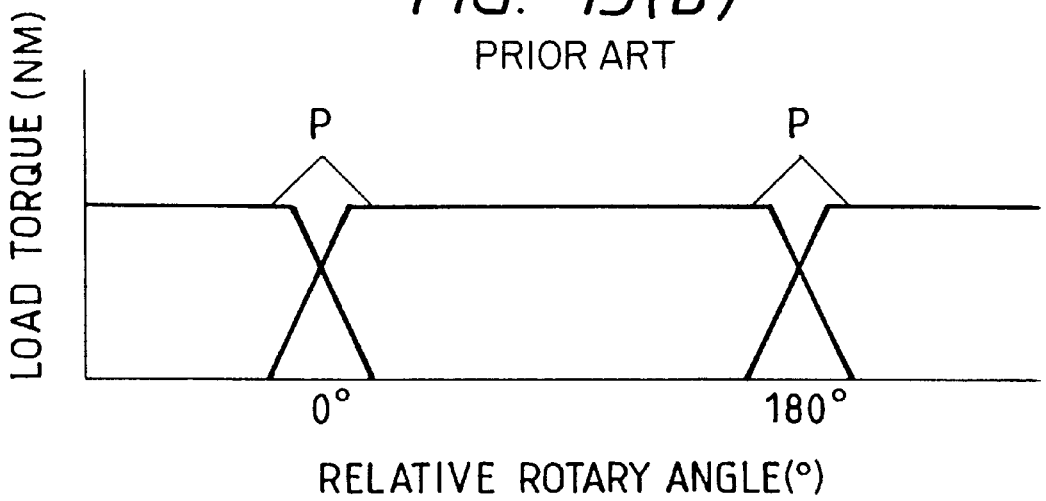
FIG. 13(b) PRIOR ART

Accordingly, as shown in FIG. 13(*a*), the load torque of the motor 10 at a point of time when the pulleys are switched from one pulley 31 to the other pulley 32 is substantially in the stationary state. That is, the load torque is substantially equivalent to the value of the load torque when one of the pulleys 31 and 32 stationarily squeezes the tube 22. Consequently, the fluctuation of torque is extremely smaller than in the conventional pump at the pulley switching time as shown in FIG. 13(*b*).

The central angle θ1 of the tube squeezing region is determined based on the ratio of the diameter of the pulleys 31 and 32 as compared to the radius of curvature of the tube 22 in the region contributing to the pumping operation. In this embodiment, however, the suitable value of the angle θ is 173° because the diameter of the pulleys 31 and 32 is selected to be about 8 mm and the radius of curvature of the tube 22 is selected to be about 10 mm. In this regard, it is noted that if the angle θ1 is set to be excessively small, a time during which both the pulleys 31 and 32 are separated from the tube 22 in the pumping operation occurs, thus making the pulsation large even though the maximum value of the load torque is reduced. It is therefore desirable to select a suitable value of the angle θ1.

Figure 9A:
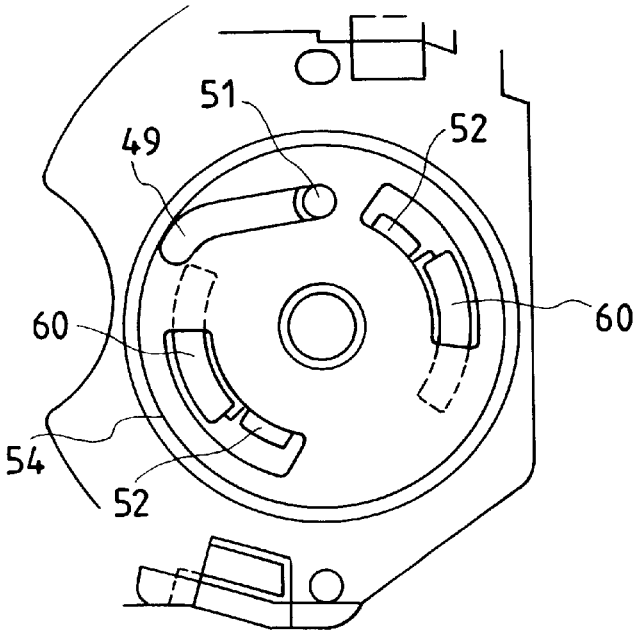
FIGS. 9(*a*) and 9(*b*) illustrate the operation of a cleaner cam plate in accordance with the embodiment of the pump unit as shown in FIG. 2.
Figure 9B:
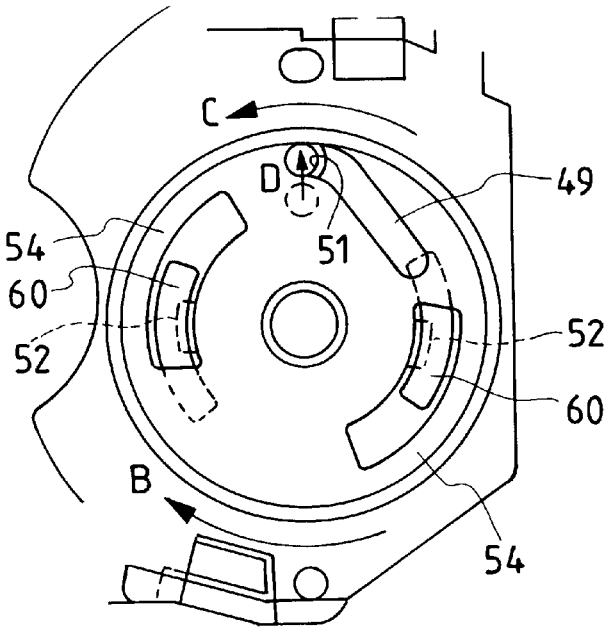

When the nozzle plate 7*a* is to be cleaned, on the other hand, the carriage 1 is slightly moved at an extent that the capping state can be released (i.e., so that the capping device 14 is removed from the nozzle plate 7*a*), so that the pump wheel 28 remains in the state where the change-over lever 83 causes the pump wheel 28 to engage with the motor 10 through the change-over toothed gear 76. When the motor 10 is driven in one direction so as to rotate the pump wheel 28 by the angle θ2 (FIG. 7) in this state, the pulleys 31 and 32 only move in the supporting slots 41 and 42 respectively without squeezing the tube 22. As shown in FIG. 9(*b*), however, the cleaner cam plate 54 rotates in the direction of an arrow B so that the projection 51 of the blade operation rod 50 is pulled up by the slot 49, as shown by an arrow D, to thereby move the cleaning blade 62 upward to the state shown in FIG. 8(*b*).

When the carriage 1 is moved to slightly reciprocate to thus cause the change-over lever 83 to move, the nozzle plate 7*a* is scraped by the blade 62 so that residual ink or paper powder on the surface is removed. When the motor 10 is driven in the other direction so as to rotate the pump wheel 28 by the angle θ2 after completion of the cleaning, the cleaner cam plate 54 rotates in the direction of an arrow C without making the pulleys 31 and 32 squeeze the tube 22. Hence, the projection 51 of the blade operation rod 50 is pulled down by the slot 49 to thereby cause the cleaning blade 62 to descend to the position shown in FIG. 8(*a*).

When the capping state is released for printing and the carriage 1 moves to the printing region through the specific path, the change-over lever 83 is released from the carriage 1 so that the change-over toothed gear 76 is moved against the torsion spring 86 by the urging force of the compression spring 80 to release meshing between the second toothed gear 78 and the toothed gear 70. As a result, the motor 10 engages only with the paper feed roller so that the paper feed operation can be performed again, and printing can continue.

As described above, in the present invention, the maximum contact region between the tube and the pulleys in the pump frame is selected to be smaller than 180°, and preferably, 173°. Accordingly, the amount of load applied to the pulleys to cause one of the pulleys to press against the tube at the time when the other pulley is being separated from the tube is made approximately equal to the value of the load applied to a pulley when it squeezes the tube. Hence, a sudden fluctuation in the load is eliminated.

Also, the damper sheets are disposed in the region of the pump frame which does not affect the pumping operation. Hence, the existing space in the pump frame is used effectively and no additional space is needed to accommodate the damper sheets. Accordingly, the overall size of the pump can be kept at a minimum.

Additionally, since at least one half of the tube is bent at right angles at a position where the tube separates from the tube supporting surface and is fixed in a slot formed in the pump frame, the overall size can of the apparatus is reduced while still enabling the pipe to be freely lead to its connections.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

What is claimed is:

1. A pump unit for applying a negative pressure to a capping device which covers a nozzle opening of a recording head of an ink jet recording apparatus, said pump unit comprising:

a pump frame having a tube supporting surface which positions a portion of a tube in a curved manner to form a substantially semicircular shaped portion of the tube;

a pump wheel rotated by a driving force received from a paper feed motor;

at least one pulley, rotatably mounted on said pump wheel to squeeze the substantially semicircular shaped portion of the tube in said frame when said pump wheel is driven in a first direction, a contact angle at which said at least one pulley contacts said tube is less than 180°; and at least one elastic damper sheet which is disposed in said pump frame in opposition to said tube supporting surface and protrudes radially inward from a peripheral portion of said pump frame so as to abut against and position said at least one pulley along said pump wheel to enable said at least one pulley to contact the tube when said pump wheel is driven in said first direction.

2. A pump unit as claimed in claim 1, wherein the contact angle is 173°.

3. A pump unit as claimed in claim 1, wherein said pump frame includes a section which bends the tube at a right angle at a position where the tube separates from said tube supporting surface so that the tube extends in parallel with an axis of rotation of said pump wheel, and a slot which directs a portion of said tube.

4. A pump unit as claimed in claim 1, wherein said pump unit includes two said pulleys which are positioned symmetrically with respect to each other about a center of rotation of said pump wheel.

5. A pump unit as claimed in claim 1, further comprising a change-over apparatus which selectively engages said pump wheel with the motor.

6. A pump unit as claimed in claim 5, wherein said change-over apparatus is a compound toothed gear which is driven by movement of the carriage.

7. A pump unit as claimed in claim 1, wherein:

the ink jet recording apparatus includes a cleaning unit, said cleaning unit abutting against the recording head to clean the recording head;

said pump wheel is selectively engaged with the cleaning unit to selectively drive the cleaning unit towards and away from the recording head;

said pump unit includes two pulleys; and said pump wheel includes two slots, said pulleys are respectively movably mounted in said slots, said slots each have respective first and second ends, said respective first and second ends of each slot being separated by an angular distance from each other angularly along said pump wheel such that said pump wheel rotates by said angular distance to drive the cleaning unit to contact the recording head without causing either of said pulleys to squeeze the tube.

8. A pump unit as claimed in claim 7, further comprising a friction clutch, said friction clutch being driven by said pump wheel to make the cleaning unit contact the recording head.

9. A pump unit as claimed in claim 1, wherein said pump unit includes two pulleys, and said pump wheel rotates said two pulleys to squeeze the tube such that a load torque applied to the tube by said pulleys remains substantially constant throughout all angles of rotation of said pump wheel.

10. A pump unit as claimed in claim 1, wherein:

the ink jet recording apparatus includes a cleaning unit, said cleaning unit abutting against the recording head to clean the recording head; and said pump wheel selectively drives the cleaning unit and said at least one pulley.

11. A method for using a pump to apply a negative pressure to a capping device which covers a nozzle opening of a recording head of an ink jet recording apparatus, said method comprising the steps of:

positioning a portion of a tube inside the pump in a curved manner to form a substantially semicircular shaped portion of the tube; and driving a pump wheel, which is disposed in the pump and on which at least one pulley is mounted, to cause the at least one pulley to squeeze the substantially semicircular shaped portion of the tube in the frame so that a contact angle at which the at least one pulley contacts the tube is less than 180°, wherein said driving step comprises a step of selectively engaging the pump wheel with a cleaning blade to selectively drive the cleaning blade towards and away from the recording head without causing the at least one pulley to squeeze the tube.

12. A method as claimed in claim 11, wherein the contact angle in said driving step is 173°.

13. A method as claimed in claim 11, wherein said driving step comprises a step of driving the pump wheel to cause two pulleys to squeeze the substantially semicircular shaped portion of the tube in the frame.

14. A method as claimed in claim 11, wherein said driving step comprises a step of selectively engaging the pump wheel with a motor that drives a paper feed roller.

15. A method as claimed in claim 11, wherein said driving step comprises driving the pump wheel to rotate two pulleys to squeeze the tube in a manner so that a load torque applied to the tube by the pulleys remains substantially constant throughout all angles of rotation of the pump wheel.

* * * * *